United States Patent [19]

Schneider-Muro

[11] Patent Number: 4,522,324

[45] Date of Patent: Jun. 11, 1985

[54] STITCHING DEVICE

[76] Inventor: Karl W. Schneider-Muro, In der Breiti 13, CH-8047 Zürich, Switzerland

[21] Appl. No.: 591,315

[22] Filed: Mar. 19, 1984

[30] Foreign Application Priority Data

Mar. 31, 1983 [CH] Switzerland ..... 1804/83

[51] Int. Cl.[3] ..... D05B 85/10; D05B 87/02; D05B 97/10

[52] U.S. Cl. ..... 223/102; 223/99

[58] Field of Search ..... 112/80, 113, 169, 222, 112/225; 223/99, 102, 103

[56] References Cited

U.S. PATENT DOCUMENTS 313,710 3/1885 Connett, Jr. ..... 112/80
2,777,623 1/1957 Balzer ..... 223/99

FOREIGN PATENT DOCUMENTS 698761 11/1940 Fed. Rep. of Germany ..... 223/102
913381 1/1955 Fed. Rep. of Germany ..... 223/99
821180 11/1937 France ..... 223/102
270031 11/1950 Switzerland ..... 223/99
903464 8/1962 United Kingdom ..... 112/80

*Primary Examiner*—Wm. Carter Reynolds
*Attorney, Agent, or Firm*—Tilton, Fallon, Lungmus & Chestnut

[57] ABSTRACT

The stitching device is used for stitching work, for instance, on upholstery or mattresses and includes a hollow needle (1), and intermediate piece (2), and a guide tube (3) for a push rod. Laterally on the intermediate piece there is attached a magazine (14) in which a stack of pins (5) is located. On the magazine there is also provided a handle (6) and a holder (7) for a thread bobbin (71). The thread (F) goes through the entire stack of pins and emerges the needle (1) laterally at the bottom. During operation, the needle (1) is pushed through the object to be sewn until its point protrudes at the bottom of the object. By pressure on the bottom (33), the push rod is operated and pushes a single pin (5) out of the lower opening of the needle with the needle pulling the thread along therewith. Now the needle can be pulled out of the object—with the pin (5) holding the thusly formed loop on the bottom side of the object.

8 Claims, 4 Drawing Figures

STITCHING DEVICE

BACKGROUND AND SUMMARY OF INVENTION

The invention relates to a stitching device having a hollow sewing needle for stitching work such as the putting of buttons onto upholstery, the stitching of upholstery materials or the sewing on of elastic springs—with the needle penetrating into a hollow space which is not accessible from the outside.

Up to now, one used for this purpose a device having a hollow needle into which a pin or apertured plate threaded on a piece of thread was inserted. After the needle equipped in this manner has been pushed through, the pin can be pushed out by means of a push rod extending through the shaft of the needle. The respective threading of the pin and its placement in the needle has been bothersome and time consuming. Furthermore, the thread had to be cut after each stitch so that a pin could be threaded again.

It is the object of the invention to develop a stitching device by means of which work can be done more efficiently than before. The invention solves this problem by a device having a hollow needle by means of which, as before, a pin can be brought from one side of the pieced object to its other side and can be pushed out thereof by means of a push rod which can be slid into the needle. Compared to that, however, the device as defined in the invention is distinguished by the special characteristics in particular a magazine holding a plurality of threaded pins.

In the drawing, a device of the well-known type as well as an embodiment of the device as defined in the invention is illustrated, namely FIG. 1 shows a well known device for stitching work;

DETAILED DESCRIPTION

Figure 1:
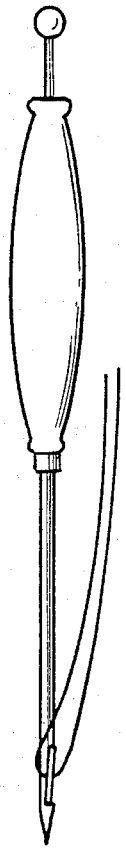
FIG. 1 PRIOR ART

The device illustrated in FIG. 1 shows the state-of-the-art. The needle proper has near its tip a recess into which a pin threaded manually each time is inserted. A handle is provided on the upper end of the needle. A push rod goes through the needle and the handle by means of which the pin can be pushed out of the recess after the object to be sewn has been pierced. The stroke of the push rod is small because it needs only to push out the pin previously inserted in the bottom of the needle.

Figure 2:
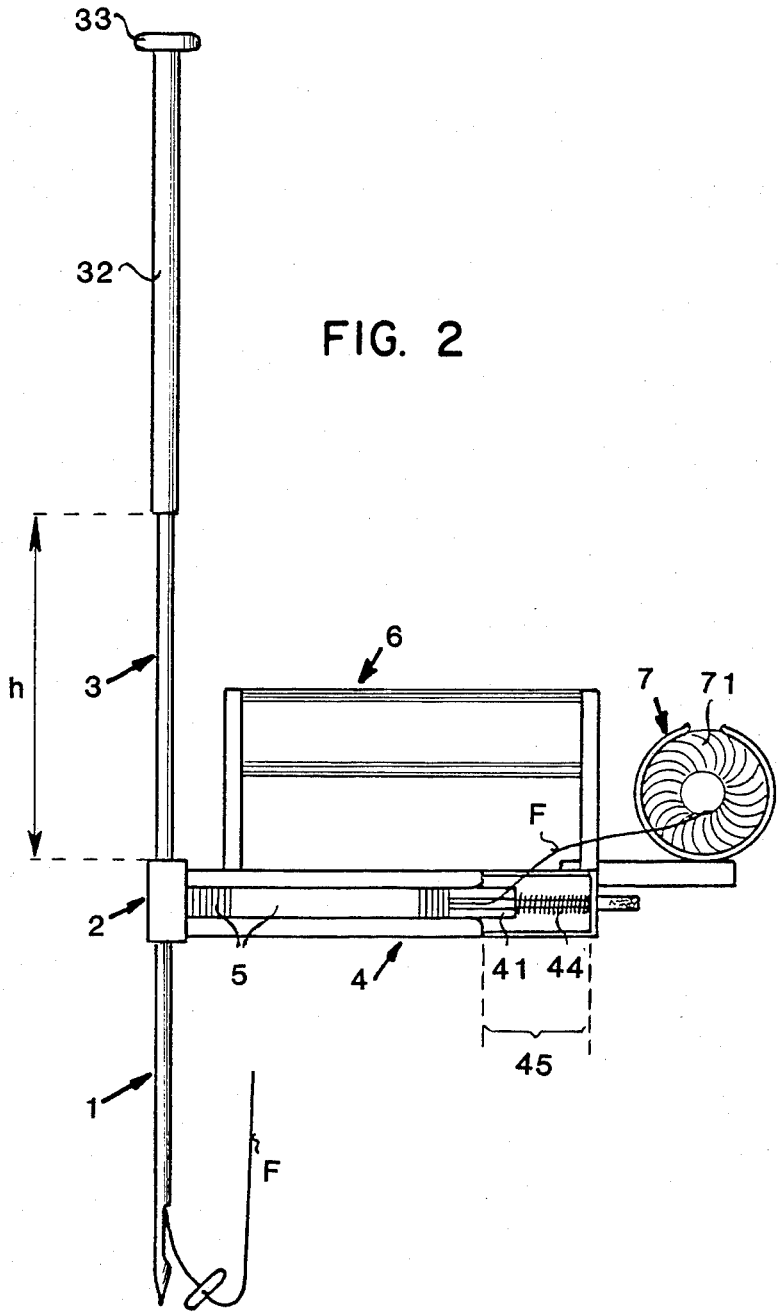
FIG. 2 shows a device as defined in the invention in a side elevational view.

The device illustrated in FIG. 2 differs considerably from the well-known device described before, for instance, by a push rod which has a much larger stroke because it must push the pin through the hollow needle from top to bottom.

The essential components of the device are a hollow needle 1, an intermediate part or bracket 2, a pushing rod with guide tube 3, a magazine 4 with a stack of pins 5 stacked vertically to the longitudinal axis of the needle, a handle 6 connected to the magazine, and a holder 7 for a thread bobbin also connected to the magazine.

Figures 3, 4:
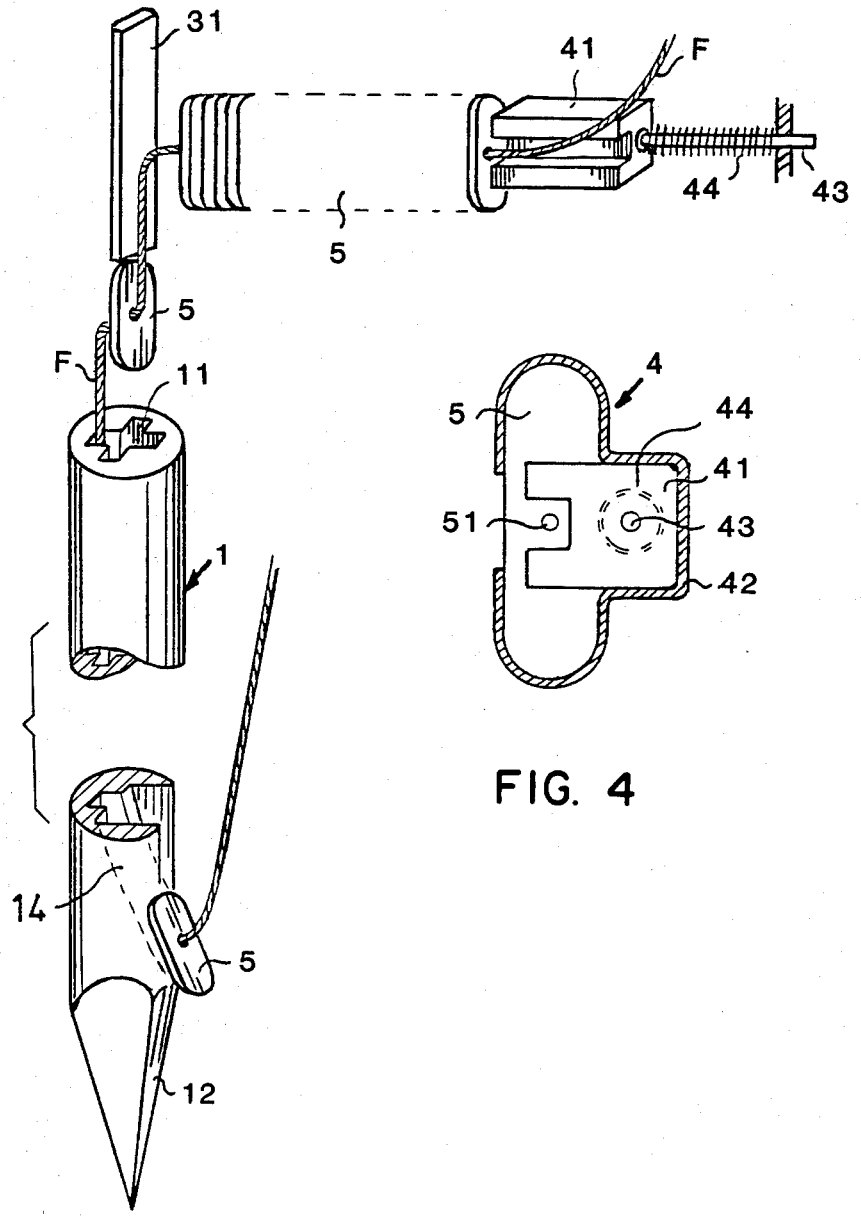
FIG. 3 shows a schematized perspective illustration of the working mode of the device according to FIG. 2.
FIG. 4 shows a sectional view of the magazine.

For a better understanding of the following description of the details reference is made also to FIGS. 3 and 4 in which the main components are provided with the same reference numerals and wherein the details of the embodiment are better visible.

The hollow sewing needle 1 proper has an inside shape whose cross section is a right-angled cross 11 (see FIG. 3) where the upper portion of needle 1 is the bracket 2. The dimension of this cross shape is such that it serves to guide a pin or apertured plate 5 so that a pin sliding in two opposite arms of the cross can go through the needle. The arms remaining before and behind the pin serve to let thread F pass through unhindered. In the lower zone near the tip 12 there is arranged a lateral outlet opening having a slanting slide path 14 communicating with the cross arms.

The intermediate piece 2 connects the needle 1 with the magazine 4 and with the guide tube 3 of the push rod 31 which is visible in FIG. 2 and designated in FIG. 3. In its side directed toward the magazine, the intermediate piece has an opening which corresponds to the shape of the pin 5. The blind hole-like opening ends exactly at the arm of the cross-shaped hollow space of the needle that is farthest away from the magazine.

The push rod is dimensioned (advantageously rectangular in cross section as seen in FIG. 3) in such a way that it can also penetrate into the cruiciform, viz., cross-shaped, inside of the needle. Since the push rod 31 is relatively long and has a stroke h which corresponds to the length of the needle, it is guided in the guide tube 3. Whereas the push rod proper is guided in the tube 3, its operating elements in the form of a second guide tube 32 are slidingly guided outside the guide tube. A return spring (not visible) is in the tube 32 and an operating button 33 is attached on top of the tube.

The magazine 4 contains a stack of pins 5 which are urged toward the opening in the intermediate piece 2 by a spring-loaded sliding member 41.

FIG. 4 shows a sectional view of the magazine. The shape of the cross section corresponds to the shape of the stack of pins but has an additional channel portion 42 for guiding the sliding member 41. The sliding member is additionally guided on a shaft 43 which serves simultaneously as a guide for the helical pressure spring 44 (see FIGS. 2 and 3). In FIG. 4, there is also visible the center bore 51 of the pin through which the thread F is guided.

The open zone 45 (see FIG. 2) of the magazine 4 serves for the easy loading of the magazine with pins. On the magazine 4 there is furthermore mounted a handle 6 which serves to push the needle 1 through the object to be sewn. On the magazine 4 there is also mounted an elastic holder 7 for a bobbin 71 from whose inside the thread F can be pulled out.

The use of the hollow needle can be described best by means of FIG. 2. In the initial state, the thread F is led through the entire stack of pins 5 and outward through the needle 1. The initial guiding of the thread by the needle is achieved most easily by pushing out one pin by means of the push rod 31 and the pin then pulls the thread along toward the outside. In the illustration given, the cross-shaped opening 11 in the needle 1 provides a generally cruiciform cross-section passage for the generally rectangular plates 5 which, as can be appreciated from a consideration of FIG. 3, occupy two arms of the passage with the thread F associated with each plate 5 occupying the other two arms of the passage 11. Also as can be seen in FIG. 3, the push rod 31 has a rectangular cross-sectional configuration corresponding generally to the cross-section of the plates 5. The first pin 5 shown in FIG. 2 is then pulled off the thread. Subsequently the thread can be pulled out further corresponding to the thickness of the object to be sewn. The needle is now ready for use. It is pushed through the object to be sewn, for instance, a mattress, by pressure on the handle 6. Now the push rod 31 is activated by pressure on the operating button 33 and pushes a pin 5 out of the opening 14. During this operation the pin pulls along a corresponding length of thread. The pin 5 holds the thread loop on the bottom side of the pierced object. Now the needle can be pulled out again and is immediately ready for the next stitch. Therefore sewing can be done very much faster than before.

The individual stitches are then connected on top by a continuous thread. If, for instance, buttons are supposed to be sewn on, this upper thread can be cut and the buttons can be tied on.

I claim:

1. Stitching device having a hollow sewing needle by means of which a pin can be brought from one side of a pierced object to the other side and can there be pushed out by means of a pushing rod which can be slid into the needle, characterized by the fact that on the upper end of the hollow needle (1) there is arranged a magazine (4) running perpendicular to the axis of the needle and holding a stack of pins (5), that in the zone of the magazine a thread supply spool or bobbin (71) is arranged from which a thread (F) is guided through the stack of pins and outward through the hollow needle and that each time a pin already threaded on the thread can be pushed out by means of a push rod (31) which can be slid into the hollow needle.

2. Stitching device as defined in claim 1, characterized by the fact that the inside shape of the hollow needle (1) is a cross having a right-angled cross section.

3. Stitching device as defined in claim 2, characterized by the fact that the cross-sectional profile of the push rod (31) is rectangular.

4. Stitching device as defined in claim 1, characterized by the fact that in the magazine there is arranged a spring-loaded sliding member (41) which pushes the stacked pins in the direction of the needle.

5. A stitching device comprising an elongated hollow needle having a passage extending therethrough from one end to the other and having a bracket intermediate the ends thereof, a magazine holding a stack of apertured plates and mounted on said bracket and communicating with said passage, a thread-equipped bobbin mounted on said magazine with the thread extending serially through the apertures of said plates, and a push rod mounted in said passage for sequentially pushing thread-equipped plates from said magazine out of said needle.

6. The device of claim 5 in which said magazine is equipped with a resiliently mounted sliding member for urging said plates sequentially into said passage.

7. The device of claim 5 in which said passage is generally cruciform in cross section, each plate being generally rectangular to occupy two arms of said passage with the thread length associated with each plate occupying the other arms.

8. The device of claim 7 in which said push rod has a cross section corresponding generally to the cross section of said plates.

* * * * *